US009352899B2

(12) United States Patent
Müller et al.

(10) Patent No.: US 9,352,899 B2
(45) Date of Patent: May 31, 2016

(54) TRANSPORT UNIT COMPRISING RETAINING PLATES AND CONTAINERS AND WORKING UNIT

(71) Applicant: Eppendorf AG, Hamburg (DE)

(72) Inventors: Philip Müller, Hamburg (DE); Daniel Voss, Hamburg (DE); Thomas Kamps, Hamburg (DE)

(73) Assignee: Eppendorf AG, Hamburg (DE)

( * ) Notice: Subject to any disclaimer, the term of this patent is extended or adjusted under 35 U.S.C. 154(b) by 281 days.

(21) Appl. No.: 13/930,066

(22) Filed: Jun. 28, 2013

(65) Prior Publication Data

US 2014/0008249 A1 Jan. 9, 2014

Related U.S. Application Data

(60) Provisional application No. 61/668,600, filed on Jul. 6, 2012.

(51) Int. Cl.

| | |
|---|---|
| ***B01L 9/00*** | (2006.01) |
| ***B65D 85/00*** | (2006.01) |
| ***B65D 5/50*** | (2006.01) |
| ***B01L 9/06*** | (2006.01) |

(52) U.S. Cl.

CPC . *B65D 85/00* (2013.01); *B01L 9/06* (2013.01); *B65D 5/5059* (2013.01); *B01L 2200/025* (2013.01); *B01L 2300/0832* (2013.01)

(58) Field of Classification Search

CPC ... B01L 2200/025; B01L 9/06; B65D 5/5059; B65D 85/00

See application file for complete search history.

(56) References Cited

U.S. PATENT DOCUMENTS

| | | | | |
|---|---|---|---|---|
| 1,858,856 | A | 5/1932 | Hadley | |
| 5,470,537 | A * | 11/1995 | Siegel | 422/562 |
| 8,454,909 | B2 * | 6/2013 | Martinell Gispert-Sauch | B01L 9/06 206/564 |
| 2007/0253870 | A1 | 11/2007 | Weiss et al. | |
| 2007/0272587 | A1 * | 11/2007 | Nguyen et al. | 206/562 |
| 2012/0138673 | A1 | 6/2012 | Eckert et al. | |

FOREIGN PATENT DOCUMENTS

| | | | |
|---|---|---|---|
| DE | 25 23 826 | A1 | 12/1976 |
| DE | 10 2010 033 181 | A1 | 2/2012 |
| GB | 2478703 | B * | 7/2012 |

* cited by examiner

*Primary Examiner* — Paul Hyun

(74) *Attorney, Agent, or Firm* — Vidas, Arrett & Steinkraus, P.A.

(57) ABSTRACT

A transport unit for carrying a plurality of lidded containers includes two parallel retaining plates, which have an arrangement of openings for retaining the lidded containers. The lidded containers are tubular containers with a closure lid at the top of the container which projects radially outward with respect to the container. Lidded containers of a group of lidded containers are held parallel to each other by the openings of one retaining plate, and lidded containers of another group of lidded containers are held parallel to each other by openings of the other retaining plate. The lidded containers of the one group are disposed oppositely aligned to the lidded containers of the other group and nested within each other.

18 Claims, 6 Drawing Sheets

TRANSPORT UNIT COMPRISING RETAINING PLATES AND CONTAINERS AND WORKING UNIT

CROSS-REFERENCE TO RELATED APPLICATIONS

This application claims priority to Provisional Application 61/668,600, filed on Jul. 6, 2012

STATEMENT REGARDING FEDERALLY SPONSORED RESEARCH

Not applicable.

BACKGROUND OF THE INVENTION

The invention relates to a transport unit comprising retaining plates and containers, and a working unit comprising a retaining plate, a holder and containers.

Containers in different sizes and composed of different materials are used in chemical, biochemical, biological, medical or forensic laboratories for the processing of reagents and samples. Containers for single-use, composed of plastic, that are utilized only for use with a specific liquid or liquid mixture and are disposed of afterwards, are widespread. The containers can be delivered by the manufacturer in a specific degree of cleanliness, or respectively, can be autoclaved before use. The use of single-use plastic containers avoids contamination of reagents and samples.

The containers are preferably provided with plug-like lids or with screw caps.

Single-use, plastic containers are available particularly with nominal volumes in the range of a fraction of a milliliter to 100 mL. Containers particularly with nominal volumes of 0.5, 1.0, 1.5, 2.0, 15 and 50 mL are common.

BRIEF SUMMARY OF THE INVENTION

The present application relates to containers having a closure element and a nominal volume of at least 10 mL. The nominal volume preferably amounts to a maximum of 100 mL. The nominal volumes of the containers are particularly 15 and 50 mL. These containers have a cylindrical region, a conical region at the bottom of the cylindrical region, and at the top of the cylindrical region a closure element projecting radially outward with respect to the cylindrical region. The cylindrical region is ideally cylindrical or designed having a slight conical tapering from the top downwards. The slight conicity of the cylindrical region is due to demolding-related reasons and handling reasons. The conicity particularly favors a defined seating of the container in a recess. Half of the opening angle of the conical tapering preferably amounts to a maximum of 5°, preferably amounts to 1°. If the container lid is a screw cap, the top of the cylindrical region has an external thread on the external periphery onto which the screw cap is screwed. These containers with closure element are also called "centrifuge tubes" (conical tube) and are marketed under the trade name Falcon® tubes. In this application, they are called "lidded containers" or simply "containers" in the following.

Conventionally, lidded containers are delivered in bulk in a plastic bag or on a tray (rack) with a covering of plastic film. The tray is made of Styrofoam or a compact plastic. Trays are known in the shape of a thick plate composed of Styrofoam having deep recesses in which the containers are held standing upright. Also known is a tray having a thin-walled base plate and a perforated plate held at a distance therefrom using webs, each composed of a compact plastic. The webs are connected to the perforated plate using integral hinges and latch below into holes in the base plate. The base plate has a bordering opposite each hole of the perforated plate. The containers are held at the cylindrical regions thereof in the holes of the perforated plate, and in the conical region thereof by the borderings.

Styrofoam trays have low resistance to chemicals and high temperatures. The trays composed of plastic are complicated to produce and are associated with an increased amount of waste.

For reasons of space, the containers are disposed very tightly next to each other in the trays. Consequently, only a small free space remains between the containers. As a result, it is difficult to access the containers on the tray. This is particularly disadvantageous, if the trays are used in the laboratory for providing the containers for opening and closing, filling and removal. In addition, with the known container packaging, it is disadvantageous that there is a large amount of waste. Finally, the commercially available trays often convey an impression of inferior quality.

The document GB 2 478 703A describes a container packaging having a first tray and a second tray, which each have an arrangement of recesses for holding a section of a container. The containers have a screw cap, which is screwed onto a tapered neck, so that the screw cap does not project radially outward with respect to the lower part of the container. When the packaging is closed, the recesses of each tray point inward and the recesses of the first tray are disposed offset to the recesses of the second tray. Therefore, each recess of each tray can hold a container and the containers do not touch each other when the packaging is closed. With one embodiment, the containers are held at both ends in recesses of both trays.

Based on this background, an object of the invention is to provide devices which simplify the transport of containers and working with containers while decreasing the manufacturing expenses and the amount of waste.

The transport unit according to the invention comprises two parallel retaining plates, which each have an arrangement of means for retaining lidded containers, and a plurality of lidded containers, which each have a tubular container and a closure element at the top of the container, projecting radially outward with respect to the container, wherein lidded containers of one group of lidded containers are held parallel to each other by the means for retaining of the one retaining plate, and another group of lidded containers are held parallel to each other by the means for retaining of the other retaining plate, the lidded containers of the one group are disposed oppositely aligned to the lidded containers of the other group and nested within one another.

With the transport unit according to the invention, the lidded containers of the one group are oppositely aligned to the lidded containers of the other group. For retaining the lidded containers at the containers or closure elements thereof, the retaining plates each have means for retaining (or retainer members). The closure elements projecting radially outward with respect to the containers do not prevent bringing adjacent lidded containers close together. Specifically, different groups are oppositely aligned so that the closure elements thereof are disposed apart from each other, next to the different retaining plates, and not next to each other on the same retaining plate. Therefore, the lidded containers can be disposed very closely next to each other in the transport unit. In addition, the material expenditure for the retaining plates is low. The plates can be designed having thin walls. However, the transport unit has high stability, because each lidded container is held at at least one retaining plate and by the nested arrangement of the two groups of lidded containers. For using the lidded containers, the retaining plates with the respective group of lidded containers held thereon, can be pulled apart from each other, and the lidded containers can be removed from the respective retaining plate. However, it is also possible to remove individual lidded containers directly from the transport unit. After removing the lidded containers, the retaining plates can be disposed of, or reused. Thus, the transport unit according to the invention on the whole saves material and avoids large amounts of waste.

According to one design, the transport unit has an external packaging enveloping the two groups of lidded containers and the two retaining plates. Hereby, the retention strength of the transport unit is improved, and the containers are protected from contamination and other adverse environmental influences. The packaging can particularly be a bag or plastic film, a blister tray or a folding box. Additionally combinations of the aforementioned external packagings can be used.

According to one design the spacing of the means for retaining in the retaining plates and the lidded containers is dimensioned so that the closure elements of adjacent lidded containers from different groups partially overlap each other. A particularly space-saving arrangement is hereby attained.

According to a further design, the means for retaining and the lidded containers are dimensioned so that the lidded containers are held clamped by the means for retaining. A particularly stable transport unit is hereby attained. Furthermore, the separation of the transport unit into two retaining plates that are separated from each other and equipped with lidded containers is simplified.

The means for retaining of the transport unit preferably retain lidded containers having a nominal volume of 50 mL and/or containers having a nominal volume of 15 mL.

Basically, the transport unit according to the invention can be held together in that the two groups of lidded containers are disposed nested within each other. As a result of this, frictional forces which can sufficiently hold the transport unit together, act between the lidded containers of different groups. Additionally, the transport unit can be stabilized by an external packaging, which holds the two retaining plates and/or groups of lidded containers, such that the displacement thereof within the transport packaging is prevented.

According to a preferred design of the transport unit, the two retaining plates each have first means for retaining lidded containers with a first diameter and second means for retaining lidded containers with a second diameter, wherein the first and the second means for retaining of the two retaining plates face each other pairwise, the lidded containers of one group are held at the containers or the closure elements by the first means for retaining of the one retaining plate, and at the containers by the second means for retaining of the other retaining plate, and the lidded containers of the other group are held at the containers or the closure elements by the first means for retaining of the other retaining plate and at the containers by the second means for retaining of a retaining plate. With this design, the lidded containers of both groups are each held at both retaining plates. For this purpose, both retaining plates each have first and second means for retaining, wherein the first means for retaining respectively hold a lidded container further at the top of the container, or at the closure element, and the second means for retaining hold a lidded container further at the bottom of the container.

In this application, the first and second means for retaining are also called "means for retaining" or "retainer members", when the description relates to both the first means for retaining as well as the second means for retaining.

The working unit according to the invention comprises at least one retaining plate, which has an arrangement of means for retaining lidded containers, a holder, which has a base and projecting upward from the base has support means, on which the at least one retaining plate rests, and a plurality of lidded containers, which each have a tubular container and on top of the container, a closure element projecting radially outward with respect to the container, and are held at the top of the container or the closure element by means for retaining of the retaining plate.

The working unit according to the invention allows very good operability and accessibility of the lidded containers in the laboratory. The lidded containers are held stably in a predefined orientation by the means for retaining of the retaining plate. In the region of the closure elements, the containers can have a spacing from each other which eases grasping, opening and closing and filling of individual lidded containers. The working unit can be advantageously completed by a retaining plate of the transport unit according to the invention that is equipped with lidded containers. For this purpose, the retaining plate with the lidded containers held by the means for retaining, can be placed on top of the support means of the holder. Free spaces on the means for retaining of the retaining plate that are not occupied, can be used for controlling the correct alignment of the retaining plate on the support means. The holder can be reused. It can be designed having high quality and an attractive appearance. After removing all the lidded containers, the retaining plate can be removed from the holder and disposed of, or reused. Afterwards, a further retaining plate that is equipped with lidded containers, can be placed on the holder, for example the second retaining plate of a transport unit. Overall, the working unit saves manufacturing expenses and the amount of waste is reduced. The working unit can also be used for receiving used lidded containers, in order to collect these in the retaining plate and dispose them of together with the retaining plate.

According to one design, the lidded containers have slightly conical cylindrical regions, the means for retaining and the slightly conical cylindrical region are dimensioned so that in the case of a retaining plate removed from the holder, the lidded containers can be inserted in a deep location in the means for retaining, in which they are held by the means for retaining clamping at the slightly conical cylindrical region, and the support means and the slightly conical cylindrical regions are dimensioned so that with the retaining plate seated upon the support means, the retaining plate is lowered with respect to the slightly conical cylindrical regions of the lidded container so that the lidded containers are held with clearance by the means for retaining of the retaining plate. According to this design, the lidded containers are securely held by the retaining plate before the retaining plate is placed on the holder. This is advantageous for the stability of a transport unit formed by two retaining plates equipped with lidded containers. In addition, this is advantageous for transferring a retaining plate equipped with lidded containers from the transport unit to the holder. The retaining plate with the lidded containers held clamped can be aligned easily to the support means and can be placed thereupon. In the removed retaining plate, the lidded containers are only held loosely in the retaining plate such that they can be easily removed from the working unit.

According to one design, the retaining plate has first means for retaining lidded containers on a first diameter, and second means for retaining lidded containers on a second diameter, and large lidded containers are held by the first means for retaining on a large diameter and/or small lidded containers are held by the second means for retaining on a small diameter.

The retaining plate can preferably be equipped with large containers, which are held by first means for retaining, or with small containers, which are held by second means for retaining, and/or by first means for retaining, or with large containers, which are held by first means for retaining, and with small containers, which are held by second means for retaining. All variants of equipping provide easy accessibility of the closure elements for opening, or respectively closing, the container, filling the open container with liquid and removing the container from the holder.

The large containers have a preferred nominal volume of 50 mL.

The small containers are preferably containers having a nominal volume of 15 mL.

According to a preferred design, the holder has support means on at least two opposing sides. According to a further design, the support means have posts projecting from the base and/or sidewalls projecting from the base. The posts are preferably disposed at the corners of the base. The design having posts is particularly material-saving. The design having sidewalls is particularly stable.

According to a further design, the support means have alignment means at the top, and the retaining plate has further alignment means at which the retaining plate is aligned with the alignment means. By using the alignment means, the retaining plate and the holder are combined into a stable arrangement. According to a further design, the retaining plate and the support means have latch means and/or clamping means for snapping together, or for the clamping connection of the retaining plate and support means.

According to one design, positioning means are disposed on the top side of the base and are disposed opposite the means for retaining the retaining plate, and the lidded containers, held by the means for retaining, are held at their lower ends by positioning means. The lidded containers are held particularly stable in a predefined alignment by using the means for retaining and the positioning means.

According to a further design, the positioning means have recesses on the top side of the base, receiving the lower ends of lidded containers, and/or a coating on the top side of the base having an increased static friction to the lower ends of the lidded containers. The coating can additionally counteract a rotation of the lidded container when using only one hand to loosen or respectively tighten a closure element formed as a screw cap.

According to a further design, the holder on the lower side of the base has feet which at least at the lower end are composed of a material having an increased static friction with respect to a work surface in the laboratory. The work surface is a surface composed of plastic, ceramics, stoneware, glass or another material commonly used in the laboratory. The feet prevent the working unit from unintended slipping on the work surface, particularly during the removal of containers.

According to a further design, the working unit has a housing surrounding the holder and the inserted containers and/or the retaining plate equipped with containers. The housing preferably has a rectangular base area with one or more edge lengths of 130 mm each or an integer multiple or factor thereof. The housing allows storage of the containers in the holder, for example, in the refrigerator or in a freezer. A housing having the specified base area can be placed in freezer boxes having one or more edge lengths of 130 mm each or an integer multiple or factor thereof. According to a further design, the housing has a lid, which in the open position allows removal and insertion of the working unit and/or the retaining plate equipped with containers, and in the closed position protects from environmental influences. The housing is preferably reusable. Alternatively, an external packaging of the transport unit can be used as a housing.

The subsequent designs apply to both the transport unit and the working unit.

According to one design the means for retaining are disposed in rows and columns. According to a preferred design the rows have a constant spacing from each other and the columns have a constant spacing from each other. According to a further design, the rows have the same spacing from each other as the columns.

According to a further design, first and second means for retaining are disposed alternating in each row and in each column, and the first means for retaining as well as the second means for retaining are disposed offset to each other in adjacent rows and columns. This design allows to form a transport unit with two identical retaining plates. In addition, a particularly high packing density can be attained due to the arrangement of the first and second means for retaining.

According to a further design, the spacing between adjacent means for retaining is 55 to 65 mm—preferably 59 mm—and/or the retaining plate and/or the holder have a rectangular base area with one or more edge lengths of 130 mm or an integer multiple or factor thereof. With this spacing between the means for retaining, a particularly high packing density can be attained. Furthermore, the base area of the retaining plate, or respectively, of the holder allows the arrangement of retaining plate, or respectively holder in a freezer box. Freezer boxes typically have a base area of one or more edge lengths of 130 mm or an integer multiple thereof.

According to a preferred design, the means for retaining have holes in at least one retaining plate for receiving containers or closure elements, and/or engagement means at the inside of at least one retaining plate in engagement with closure elements, and/or engagement means at the inside of at least one retaining plate in engagement with lower ends of lidded containers, and/or contact surfaces at the inside of at least one retaining plate disposed between first means for retaining.

With the first variant of the means for retaining, the retaining plate is designed as a perforated plate. The perforated plate is preferably provided with first holes for a first diameter of the lidded containers, and with second holes for a second diameter of the lidded containers. The first holes are preferably larger than the second holes. In this application, the first holes and the second holes together are also called "holes".

The engagement means in engagement with the closure elements have, for example, a collar projecting from the inside of the retaining plate and receiving a closure element, and/or a projection projecting from the inside of a retaining plate and engaging in a recess at the outside of the closure elements. The engagement means in engagement with the lower ends of the lidded containers have, for example, a collar projecting from the inside of a retaining plate and receiving an end section of the conical region, and/or a recess disposed at the inside of a retaining plate and receiving an end section of the conical region.

The means for retaining, according to a further variant are implemented such that they have a contact surface at the inside of a retaining plate for the lower end of the lidded container. The lidded containers resting with the lower ends on the contact surfaces are supported in the axial direction by the contact surface. In addition, the lidded containers are supported laterally by the adjacent lidded containers, which are held by the retaining plate with the contact surface. The different variants of the first and second means for retaining can be present also in any combination in a transport unit and/or in the working unit.

With one design of the transport unit, in which the means for retaining are holes in a retaining plate, the containers with the closure elements held in these holes are disposed on the outside of the retaining plate facing away from the other retaining plate. With a design of the working unit, in which the means for retaining the lidded containers are holes, the lidded containers with the closure elements thereof held in these holes are disposed on the outside of the retaining plate facing away from the base.

According to a further design, the means for retaining in each case have webs disposed in a cutout of the retaining plate, between which an opening region is present in which a lidded container can be inserted. For example, three or four such webs project radially inwards from the edge of the cutout, in order to limit the opening region with the inner ends thereof. The webs can also limit the opening region tangentially. The webs can be formed to be rigid or elastic.

According to a further design, the retaining plate and/or the holder and/or the lidded containers are produced at least from one plastic. Preferably the materials used can be autoclaved and/or are resistant to chemicals. Furthermore, the retaining plate and/or the holder are preferably composed of a biobased plastic, in order to reduce waste problems.

According to a further design of the transport unit and/or the working unit, the lidded containers have a tubular container having a cylindrical region and a bottom at the lower end. According to a preferred design, the cylindrical region is slightly conical, that is, it tapers from the top downwards. Half of the cone angle of the cylindrical region preferably amounts to a maximum of 5°, further preferably a maximum of 1°. The container can have only the cylindrical region with the bottom at the lower end. According to further design, the container has a conical region tapering downwards. The bottom of the lidded container is at the bottom of the conical region. The container can have only the conical region with bottom. Preferably, the conical region is adjacent <t the bottom of the cylindrical region. According to a further design, the container has a cup-shaped bottom. According to a further design, the closure element is a housing lid. According to further designs, the closure element is a snap-on cap or a plug.

According to a preferred design, the closure element is a screw cap and the container has a thread on the upper edge. According to a further design, the screw cap has an internal thread and the cylindrical region has an external thread on the upper edge.

In addition, the invention comprises a transport and working device. This device is comprised of a transport unit and a holder for forming a working unit.

Advantageous designs of the device have features of the transport unit and/or the working unit and/or the transport or working unit.

With the use according to some forms of the device, the transport unit is dismantled by separating the retaining plates from each other with, in each case, the groups of lidded containers inserted therein, and at least one retaining plate with a group of lidded containers inserted therein is placed onto the holder.

The transport unit, the working unit, the device and the use can also be implemented with lidded containers with which the closure element does not project radially outward with respect to the cylindrical element, but rather is flush with the cylindrical region or recessed, for example. These lidded containers, for example, have a closure element having an external thread that is screwed into an internal thread at the upper end of the cylindrical region, or a closure element in the shape of a plug that can be pressed into the cylindrical region. The applicant retains the right to claim these embodiments of the transport and/or working unit and/or the use.

In the present application, the specifications "at the bottom" and "at the top" relate to a transport unit and a working unit in which the containers are aligned vertically with the axes of the cylindrical sections thereof. With respect to the lidded containers, these specifications relate to a vertical alignment of the lidded containers with the closure element on top and the container below.

The invention will be further explained with reference to the accompanying drawings of exemplary embodiments. In the drawings:

DETAILED DESCRIPTION OF THE INVENTION

Figure 1:
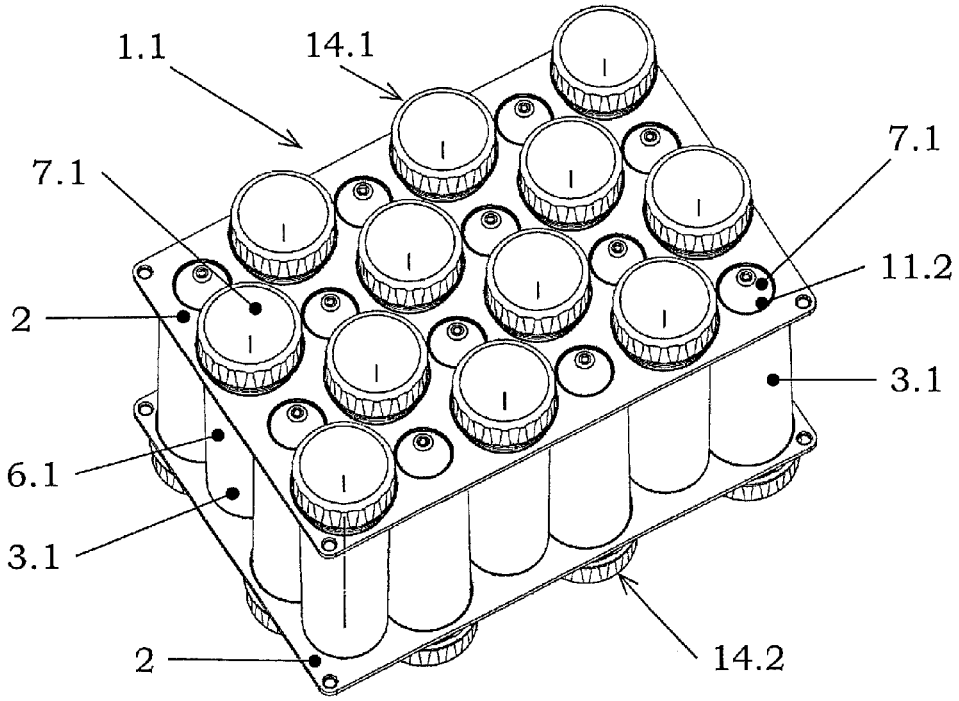
FIG. 1 shows a transport unit comprising large containers in an oblique perspective view from above and from the side.

While this invention may be embodied in many different forms, there are described in detail herein a specific preferred embodiment of the invention. This description is an exemplification of the principles of the invention and is not intended to limit the invention to the particular embodiment illustrated.

Features of the invention that are labeled with the same term, but have differing designs, are labeled with reference numbers that are the same before the decimal point and are differentiated from each other after the decimal point. In summary these features of the invention are also labeled only by the reference number before the decimal point.

According to FIGS. 1 to 4, a transport unit 1.1 comprises two retaining plates 2 parallel to each other, and large lidded containers 3.1 parallel to each other.

The large lidded containers 3.1 each have a container 4.1 that has a cylindrical region 5.1 and a conical region 6.1 having a bottom at the lower end. The cylindrical region 5.1 is not ideally cylindrical, but rather tapers slightly from the top downwards due to demolding-related reasons and handling reasons. The cylindrical region 5.1 has an external thread on the upper edge. The cylindrical region 5.1 and the conical region 6.1 are hollow and together form a receptacle for liquids.

A screw cap 7.1 having an internal thread is screwed onto the external thread. The screw cap 7.1 has a circular disk-shaped lid bottom 8.1 having a lid casing 9.1, the exterior of which is grooved, projecting radially downward from the outer edge. The screw cap 7.1 projects slightly radially outward with respect to the cylindrical region 5.1.

Figure 5:
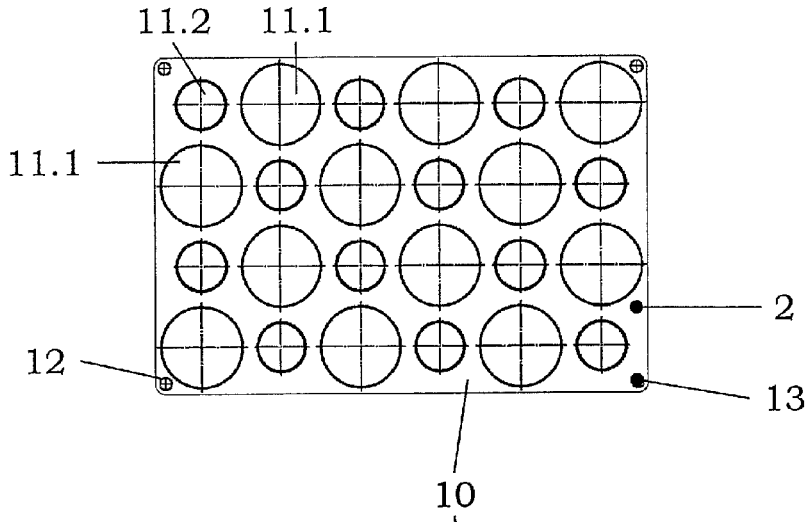
FIG. 5 shows a retaining plate of the transport unit in a top view.
Figure 6:
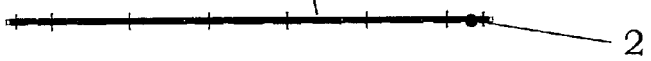
FIG. 6 shows the same retaining plate in the side view.

According to FIGS. 5 and 6, a retaining plate 2 has a rectangular plate 10, in which a plurality of first holes 11.1 and a plurality of second holes 11.2 are arranged. The first holes 11.1 are larger than the second holes 11.2. The first holes 11.1 and the second holes 11.2 are disposed in a matrix-like arrangement of four rows and six columns. In each row alternating first holes 11.1 and second holes 11.2 are disposed. Additionally, in each column alternating first holes 11.1 and second holes 11.2 are disposed. The first holes 11.1 and the second holes 11.2 are disposed offset to each other in adjacent rows. In addition, the first holes 11.1 and the second holes 11.2 are disposed offset to each other in adjacent columns.

In the example, the retaining plate 2 has twelve first holes 11.1 and twelve second holes 11.2.

The center to center distance of adjacent holes 11.1 and 11.2 in the rows and in the columns is constant. In the example, this is 59 mm.

The diameters of the first holes 11.1 and the second holes 11.2 are selected so that a large lidded container 3.1 having a screw cap and a nominal volume of 50 mL, can be inserted with the cylindrical region 5.1 thereof, being clamped, into the first holes 11.1, and that a small container 3.2 having a screw cap with a nominal volume of 15 mL can be inserted with the cylindrical region 5.2 thereof, being clamped, into the second holes 11.2.

The following table summarizes, as an example, the relevant diameters and diameter ranges of the screw caps 7 (ØLid), the cylindrical region 5 at the upper end (ØCylinder opening), the cylindrical region 5 at the lower end (ØCylinder start of conical region), the first holes 11.1 of the retaining plate 2 (Rack: LargeØ) and the second holes 11.2 of the retaining plate 2 (Rack: SmallØ) for the 50 mL lidded container 3.1 and the 15 mL lidded container 3.2. The diameters of the screw cap 7, the upper end of the cylindrical region 5 and the lower end of the cylindrical region 5 are outer diameters. The diameters of the first holes 11.1 and the second holes 11.2 are inner diameters.

Table with relevant diameters and diameter ranges:

| | Ø Lid | Ø Cylinder opening | Ø Cylinder start of conical region | Rack: large Ø | Rack: small Ø |
|---|---|---|---|---|---|
| 50 mL container | 33-36 mm | 29-30 mm | 27-28 mm | 29.5 mm | 17.5 mm |
| 15 mL containers | 20-23 mm | 17-18 mm | 15-16 mm | 16.5 mm | 13 mm |

In addition, the retaining plate 2 at each of the four corners 12 thereof has a guide hole 13.

In the transport unit 1.1 the two retaining plates 2 are disposed so that in each case a first hole 11.1 of the one retaining plate 2 is aligned to a second hole 11.2 of the other retaining plate 2.

According to FIGS. 1 to 4, the transport unit 1.1 has a group 14.1 of large lidded containers 3.1, which are inserted with the cylindrical region 5.1 into the first holes 11.1 of the retaining plate 2 so that they are held clamped therein. The screw caps 7.1 of the lidded containers 3.1 of this group 14.1 are disposed on the outside of the same retaining plate 2. The conical regions 6.1 of the large lidded containers 3.1 of this group 14.1 are disposed in the second holes 11.2 of the opposite retaining plate 2.

In addition, the transport unit 1.1 comprises a second group 14.2 of large lidded containers 3.1, which are inserted with the cylindrical region 5.1 into the first holes 11.1 of the other retaining plate 2 so that they are held clamped therein. The lidded containers 3.1 of the group 14.2 are disposed with the screw caps 7.1 thereof on the outside of the other retaining plate 2. Additionally, the lidded containers are inserted with the conical regions 6.1 thereof into the second holes 11.2 of the one retaining plate 2.

The lidded containers 3.1 are packed in particularly tightly in the transport unit 1.1. With an appropriate selection of the distances between the holes 11.1, 11.2 of the retaining plate 2, the lidded containers 3.1 can be packed so tightly that they contact each other at the outer casings of the cylindrical regions 5.1 thereof. According to FIG. 4, the screw caps 7.1 of the lidded containers 3.1 of the different groups 14.1, 14.2 overlap each other without colliding with each other because they are disposed on different outsides of the two retaining plates 2.

Figure 7:
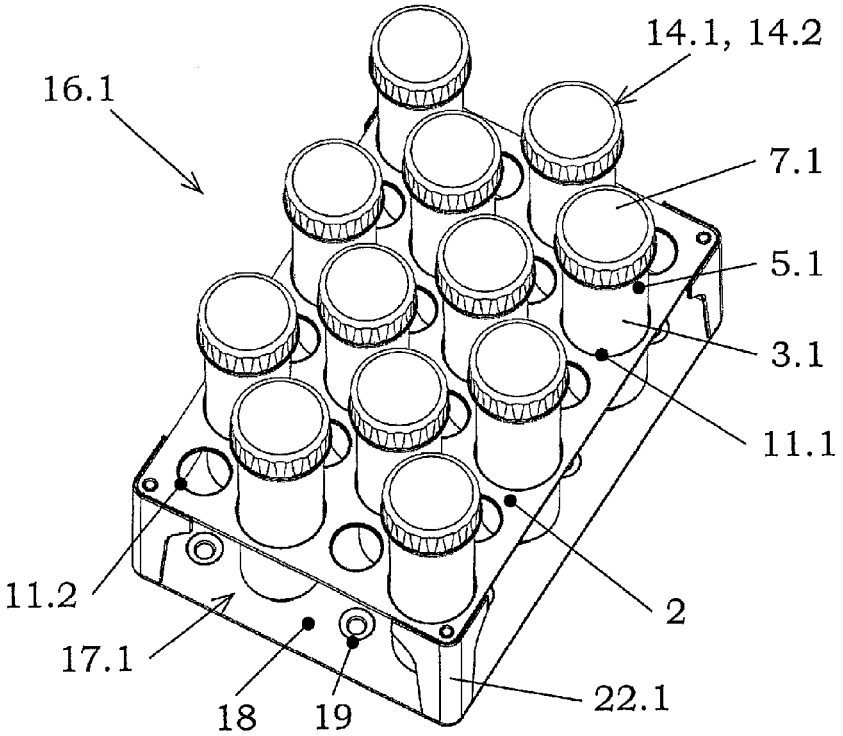
FIG. 7 shows a working unit comprising large containers in an oblique perspective view from above and from the side.

According to FIG. 7, a working unit 16.1 comprises a retaining plate 2, large lidded containers 3.1 and a holder 17.1.

Figure 8:
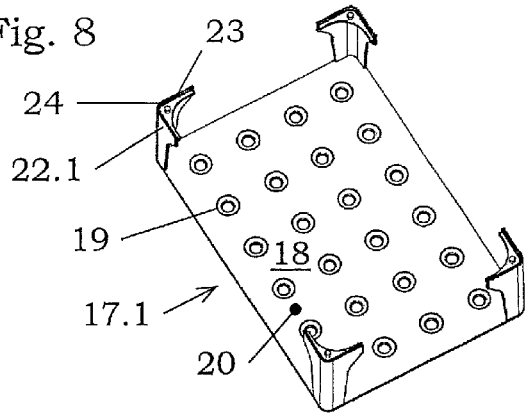
FIG. 8 shows the holder of the working unit in an oblique perspective view from above and from the side.
Figure 9:
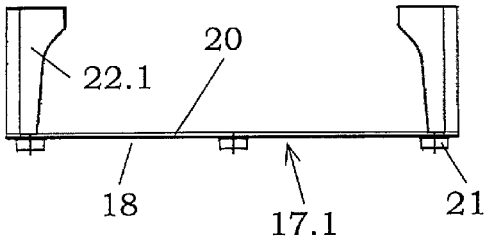
FIG. 9 shows the same holder in a front view.
Figure 10:
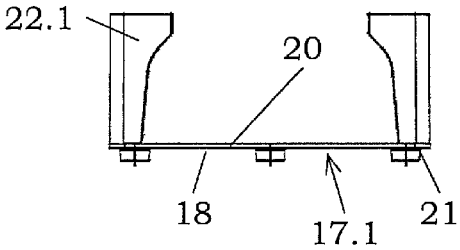
FIG. 10 shows the same holder in a side view.

According to FIGS. 8 to 10, the holder 17.1 has a base 18 in the shape of a rectangular plate. The base 18, on the top side, has recesses 19, which in the example, widen conically from below upwards. Furthermore, the top side of the base 18 has a coating 20 that has increased static friction compared to the lidded containers 3.

The recesses 19 are disposed in rows and columns in a matrix-like arrangement that corresponds to the arrangement of the holes 11 in the plate 2. The recesses 19 are designed so that they can selectively receive the conical region 6.1, 6.2 of a large lidded container 3.1 or a small lidded container 3.2.

The base 18 has feet 21 projecting from the lower side. In the example, four feet 21 are present at the corners, and a central foot 21 is present for supporting the center of the base 18. The feet 21 preferably have at least one material on the lower side thereof that has an increased static friction compared to a work surface.

Support means 22, in the shape of posts 22.1, rise upwards from the corners of the base 18. The posts 22.1 have a bearing region 23 on top for a plate 2. Above the corner of the base 18 a guide pin 24 rises upward from each bearing region 23.

Each post 22.1 is L-shaped in a horizontal section, wherein each post 22.1 widens from below upwards. The bearing region 23 in each case is plate-shaped, connected at the outer edge to the two legs of the post 22.1 and has a radius at the inner edge. Each bearing region 23 is offset somewhat downwards with respect to the upper edge of the post 22.1, wherein the offset corresponds approximately to the wall thickness of the retaining plate 2. The guide pin 24 projects approximately upwards from the bearing region 23 as far as the upper edge of the post 22.1.

According to FIG. 7, a retaining plate 2 with a group 14.1 or 14.2 of lidded containers 3.1 is placed on top of the holder 17.1. The lidded containers 3.1 are inserted with the conical regions 6.1 thereof into the recesses 19 of the base 18. The retaining plate 2 is moved downwards onto the cylindrical regions 5.1 of the lidded containers 3.1 until the guide pins 24 engage in the guide holes 13, and the retaining plate 2 rests on top of the bearing region 23. In this position, the retaining plate 2 is guided at the corners by the sections of the posts 22.1 projecting above the bearing regions 23.

The screw caps 7 can be manually screwed on or off by the user, because the coating 20 prevents the lidded container 3.1 from turning. The lidded containers 3.1 are easily removable from the working unit 16.1 because they are supported at the cylindrical regions 5.1 thereof with a low clearance due to the recessed position of the retaining plate 2.

In addition to, or instead of, the large lidded containers 3.1, small lidded containers 3.2 can also be inserted in the second holes 11.2 and possibly the first holes 11.1 provided in the working unit 16.1.

After use of the lidded containers 3 provided in the retaining plate 2, the retaining plate 2 can be removed and a further retaining plate 2 with lidded containers 3 can be inserted into the holder 17.1. The emptied retaining plate 2 can be disposed of or reused.

Figure 11:
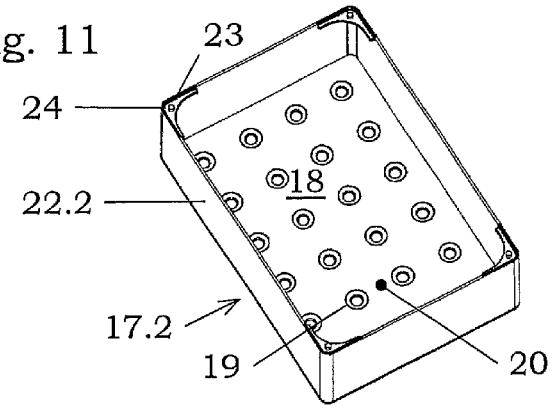
FIG. 11 shows a further holder of a working unit in an oblique perspective view from above and from the side.
Figure 12:
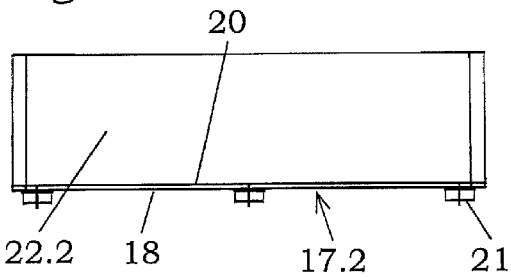
FIG. 12 shows the same holder in a front view.
Figure 13:
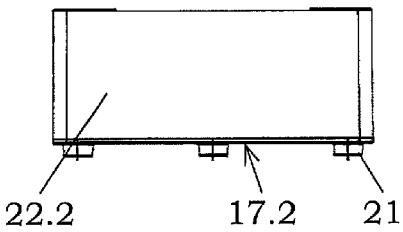
FIG. 13 shows the same holder in a side view.

The holder 17.2 of FIGS. 11 to 13 differs from the above description in that the support means 22 are designed as closed sidewalls 22.2. The sidewalls 22.2 form a circumferential frame. As a result, the holder 17.2 is particularly stabilized. The bearing regions 23 are designed as with the holder 17.1, and are offset somewhat downward with respect to the upper edge of the side walls 22.2. The guide pins 24 project upwards from the bearing region 23 up to the upper edge of the sidewalls 22.2.

A retaining plate 2 with lidded containers 3 disposed thereon can be inserted into the holder 17.2, as with the holder 17.1. The retaining plate 2 is guided laterally at the entire outer periphery thereof in the holder 17.2.

Figure 14:
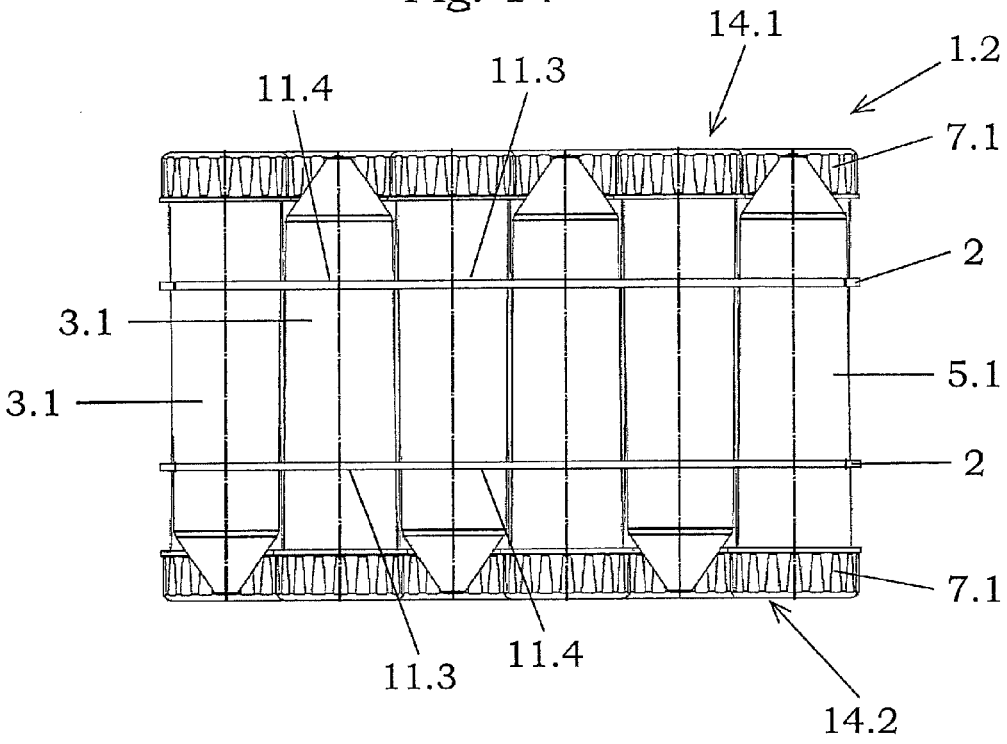
FIG. 14 shows a further transport unit comprising large containers, which are held at the cylindrical regions thereof by two perforated plates, in a side view.

According to FIG. 14, a transport unit 1.2 has two retaining plates 2, which are provided with first holes 11.3 and second holes 11.4, which hold the lidded containers 3.1 at the cylindrical regions 5.1 thereof. With this design with slightly conical cylindrical regions 5.1, the first holes 11.3 are slightly larger than the second holes 11.4. Also with this design, the lidded containers 3.1 of the different groups 14.1, 14.2 are disposed with the screw caps 7.1 thereof on outsides of the different retaining plates 2 facing away from each other.

Figure 15:
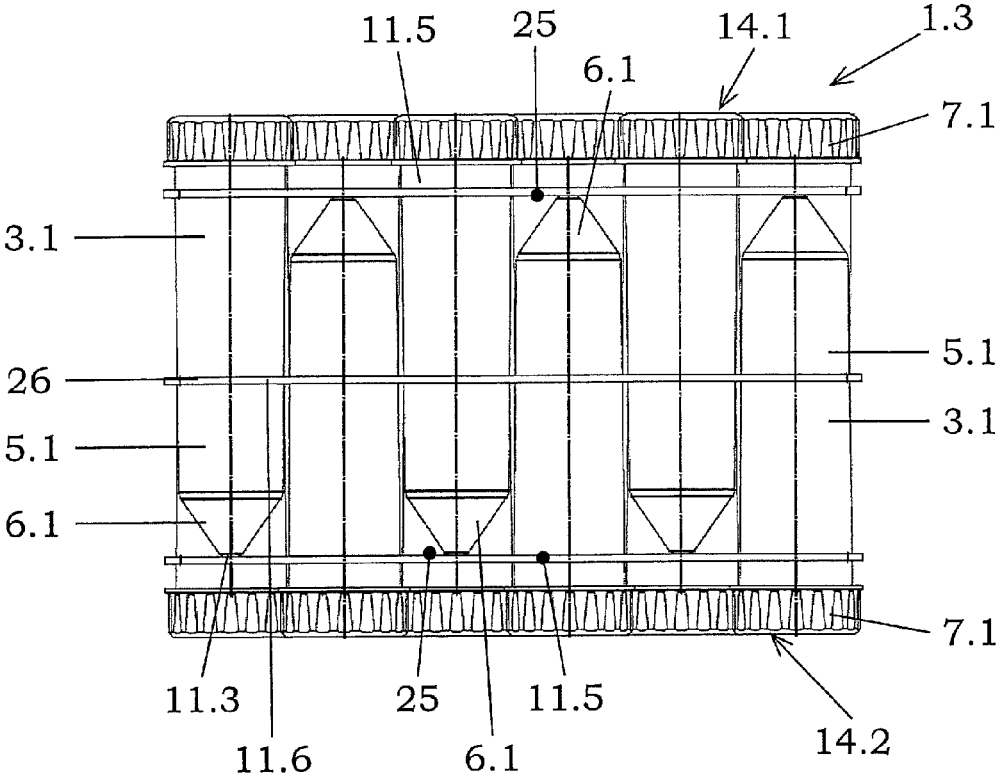
FIG. 15 shows a further transport unit comprising large containers, which are held, in each case, by a retaining plate at the cylindrical region thereof and by the other retaining plate at the stop surface thereof between further large containers.

With the transport unit 1.3 of FIG. 15, both retaining plates 2 have only first holes 11.5 and furthermore, have contact surfaces 25 at the insides of the retaining plates 2 which are disposed between first holes 11.5. The lidded containers 3.1 of the different groups 14.1, 14.2 are each held at the cylindrical region 5.1 thereof in a first hole 11.5 of a retaining plate 2, and with the ends of the conical region 6.1 thereof are supported axially at a contact surface 25. At this end, the lidded containers 3.1 are additionally supported radially by the adjacent lidded containers 3.1 of the other group 14.2, which are disposed in the first holes 11.5 next to the contact surface 25.

The transport unit 1.3 can be stabilized additionally by an external packaging. In addition, or instead of, the unit can be stabilized by an intermediate plate 26, which has further holes 11.6 that hold the lidded containers 3.1 of both groups 14.1, 14.2 at the cylindrical regions 5.1 thereof. The optional intermediate plate 26 is shown with dashed lines in FIG. 15.

Figure 16:
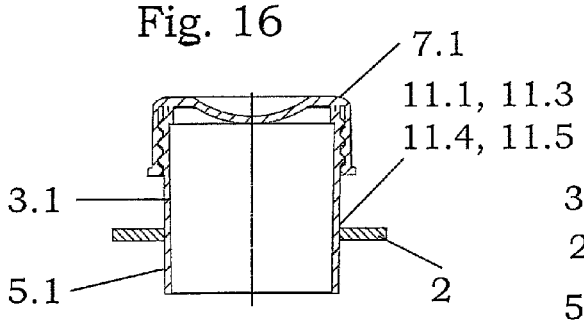
FIG. 16 shows a detail of a transport unit comprising a retaining plate with first holes for retaining containers at the cylindrical region.

According to FIG. 16, a lidded container 3.1 is held at a large diameter of the cylindrical region 5.1 thereof in a first hole 11.1 or 11.3 or 11.4 or 11.5.

Figure 17:
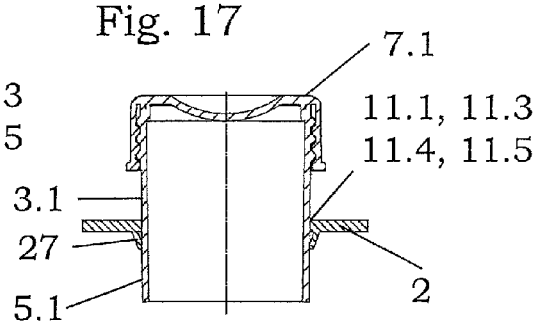
FIG. 17 shows a detail of a further transport unit comprising a retaining plate with first holes having spring elements for retaining containers at the cylindrical region.

With the embodiment of FIG. 17, additionally, at the edge of each first hole 11.1 or 11.3 or 11.4 or 11.5, a spring element 27 is present on the retaining plate 2 that secures the lidded container 3.1.

Figure 18:
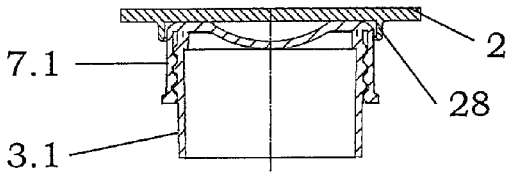
FIG. 18 shows a detail of a transport unit comprising a retaining plate with borderings for retaining containers at the closure element.

According to FIG. 18, a retaining plate 2 has a circular cylindrical collar 28 projecting from the inside, into which, in each case, a screw cap 7.1 can be inserted or clamped.

Figure 19:
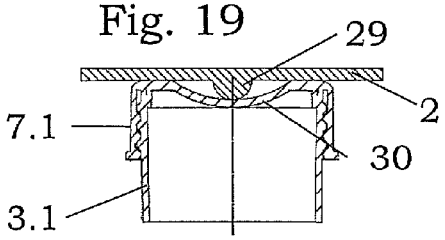
FIG. 19 shows a detail of a transport unit comprising a retaining plate with projections for retaining containers at recesses of the closure element.

According to FIG. 19, a retaining plate 2 has a first retaining means in the shape of thorn-like or pin-like projections 29 each of which engage into a trough-like recess 30 in the screw cap 7.1 of the lidded container 3.1.

Figure 20:
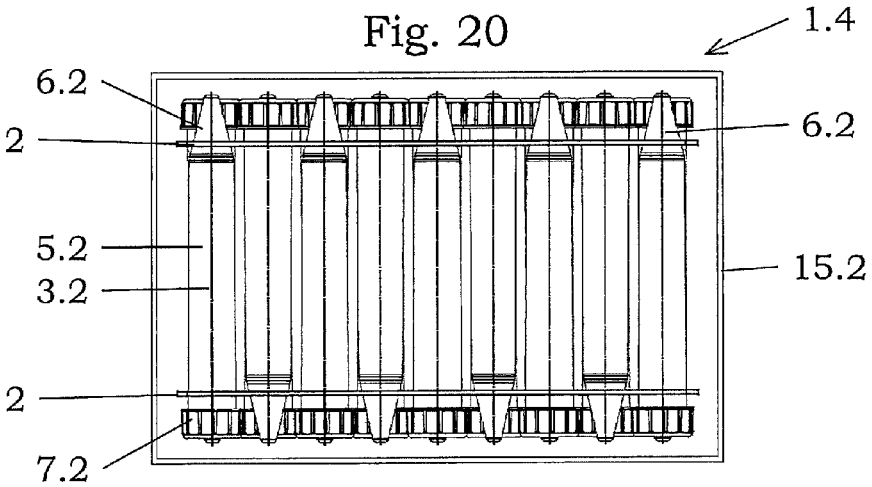
FIG. 20 shows a further transport unit comprising small containers in a top view.
Figure 21:
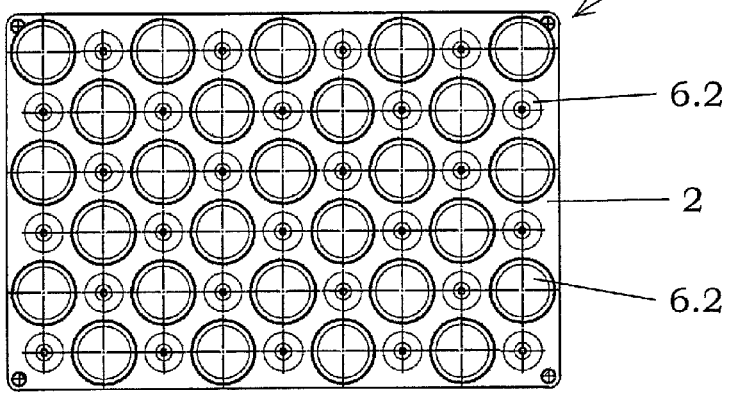
FIG. 21 shows the same transport unit in a side view.

FIGS. 20 and 21 show a further transport unit 1.4 which is comprised of two parallel retaining plates 2 and small lidded containers 3.2 inserted therein. The geometry of the small lidded containers 3.2 in principle corresponds to the geometry of the large lidded containers 3.1. The small lidded containers 3.2 also have a cylindrical region 5.2 having a conical region 6.2 at the lower end and an external thread at the top of the cylindrical region 5.2. In addition, the cylindrical region 5.2 and the conical region 6.2 are hollow and together form a receptacle for liquids. Additionally, a screw cap 7.2 having an internal thread is screwed onto the external thread. The length of the small lidded containers 3.2 is consistent with the length of the large containers 3.1. However, the small containers 3.2 have a smaller diameter than the large containers 3.1.

In the transport unit 1.4, the small lidded containers 3.2 also form two groups 14.1 and 14.2. The lidded containers of the one group 14.1 are clamped with the cylindrical regions 5.2 thereof into the first holes 11.1 of the one retaining plate 2, and with the lower ends of the cylindrical regions 5.2 thereof are clamped in the second holes 11.2 of the other retaining plate 2. The lidded containers 3.2 of the other group 14.2 are clamped with the cylindrical regions 5.2 thereof in the first holes 11.1 of the one retaining plate 2, and with the lower ends of the cylindrical regions 5.2 thereof are clamped in the second holes 11.2 of the other retaining plate 2. The screw caps 7.2 have a larger diameter than the first holes 11.1 so that they cannot slip through these holes.

Figure 2:
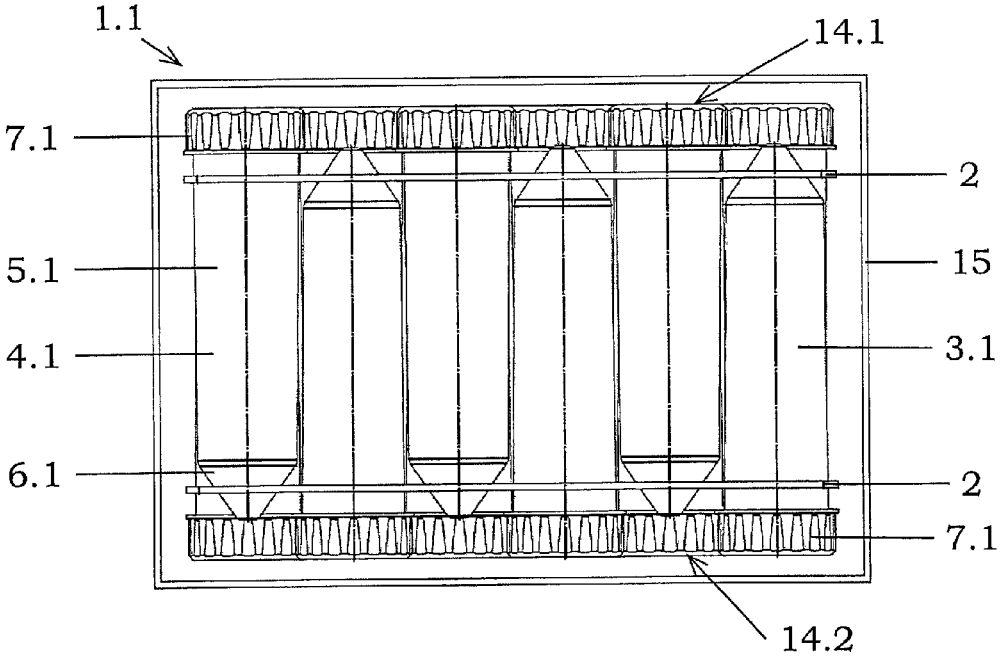
FIG. 2 shows the same transport unit in a side view.
Figure 3:
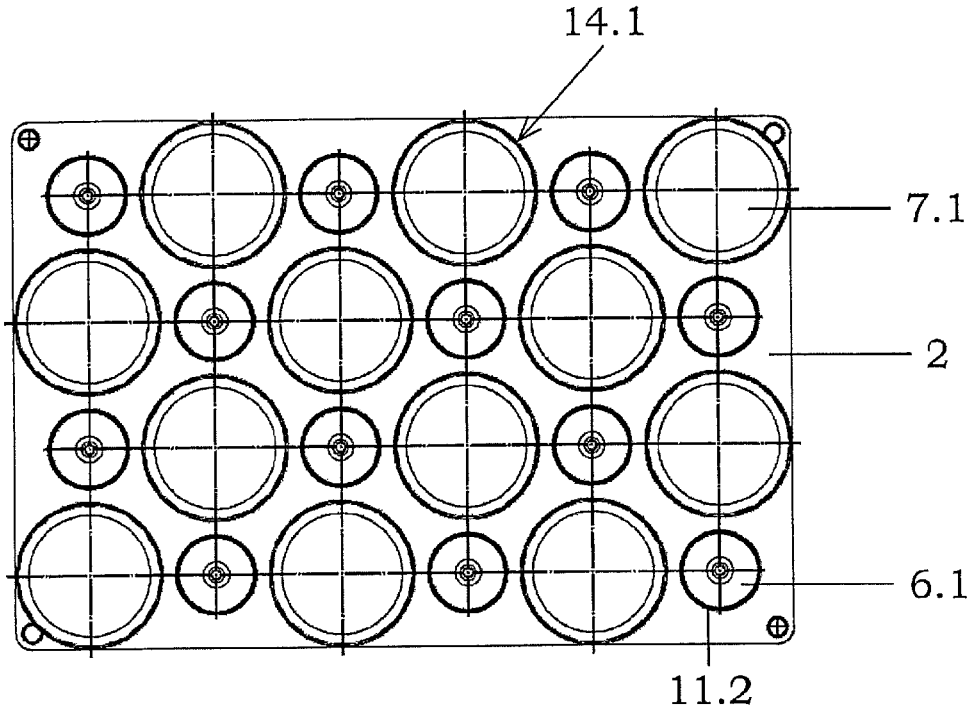
FIG. 3 shows the same transport unit in a top view.
Figure 4:
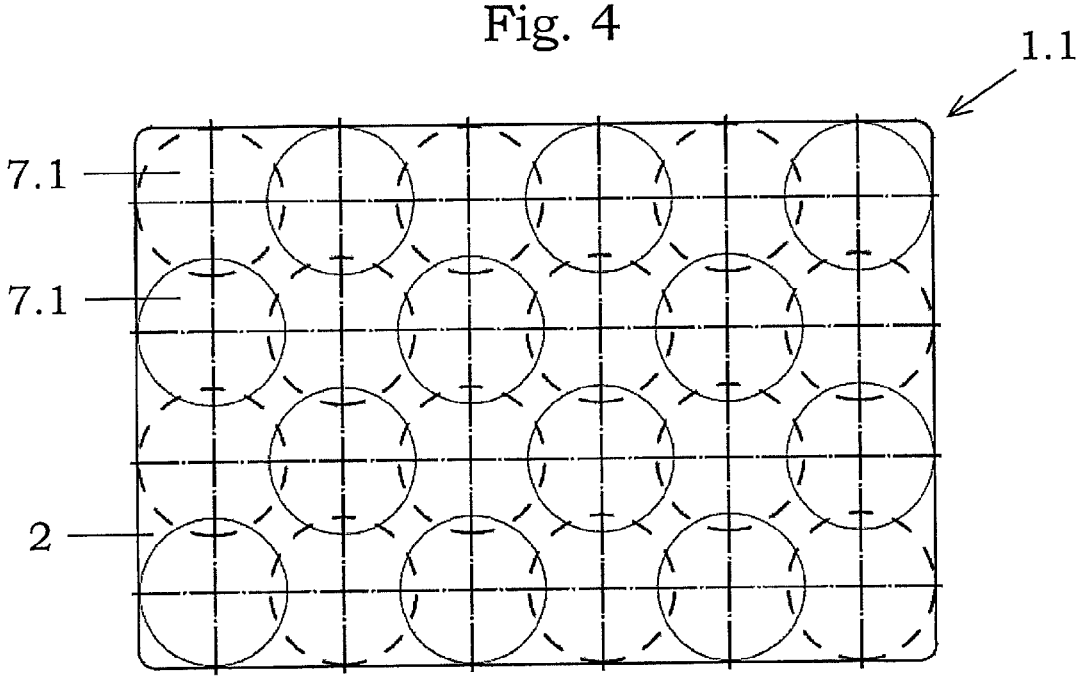
FIG. 4 shows arrangement of the screw caps of the containers in the same transport unit in a top view.

For protection from environmental influences and for stabilizing, the transport unit preferably comprises an external packaging 15. In FIGS. 2 and 20, the transport units 1.1 and 1.4 are shown with an external packaging 15.1, 15.2 made of cardboard.

The lidded containers 3 and the retaining plates 2 are preferably produced from plastic. The lower parts 4 of the containers are preferably produced from polypropylene and the screw cap 7 is produced from polyethylene. The retaining plates 2 are produced, for example, from polypropylene or polycarbonate.

The first holes 11.1 and the second holes 11.2 of the transport unit 1.5 are matched to the diameters of the cylindrical regions 5.2 and the conical regions 6.2 of the small lidded containers 3.2.

The retaining plates 2 of the transport units 1.2 to 1.4, equipped with lidded containers 3, can also be pulled apart from each other, and can be placed into a holder 17, in order to form a working unit 16.

This completes the description of the preferred and alternate embodiments of the invention. Those skilled in the art may recognize other equivalents to the specific embodiment described herein which equivalents are intended to be encompassed by the claims attached hereto.

REFERENCE LIST

1, 1.1-1.5 transport unit
2 retaining plate
3, 3.1, 3.2 lidded container
4, 4.1, 4.2 container
5, 5.1, 5.2 cylindrical region
6, 6.1, 6.2 conical region
7, 7.1, 7.2 screw cap
8, 8.1, 8.2 lid bottom
9, 9.1, 9.2 lid casing
10 plate
11, 11.1-11.6 hole-retainer members
12 corner
13 guide hole
14, 14.1, 14.2 group
15, 15.1, 15.2 external packaging
16, 16.1, 16.2 working unit
17, 17.1, 17.2 holder
18 base
19 recess
20 coating
21 foot
22, 22.1, 22.2 support means
23 bearing region
24 guide pin
25 contact region
26 intermediate plate
27 spring element
28 collar
29 projection
30 recess

What is claimed is:

1. A transport unit comprising two parallel retaining plates, each of which has an arrangement of retainer members for retaining lidded containers, and a plurality of lidded containers, each of which has a tubular container and a closure element at the top of the container projecting radially outward with respect to the container, wherein lidded containers of one group of lidded containers are held parallel to each other by retainer members of one of the two parallel retaining plates, and lidded containers of another group of lidded containers are held parallel to each other by retainer members of the other retaining plate, the lidded containers of the one group are disposed oppositely aligned to the lidded containers of the other group and nested within one another such that the lidded containers of the one group contact the lidded containers of the other group and frictional forces acting between the lidded containers of the one group and the other group hold the transport unit together.

2. The transport unit according to claim 1, having an external packaging encasing the two groups of lidded containers and the two retaining plates.

3. The transport unit of claim 1, in which the spacings between the retainer members in the retaining plates and the lidded containers are dimensioned so that the closure elements of adjacent lidded containers from different groups partially overlap each other to some extent.

4. The transport unit according to claim 1, in which the retainer members and the lidded containers are dimensioned so that the lidded containers are held clamped by the retainer members.

5. The transport unit according to claim 1, in which the two retaining plates have first retainer members for retaining lidded containers with a first diameter and second retainer members for retaining lidded containers with a second diameter, wherein the first and second retainer members of the two retaining plates face each other pairwise, the lidded containers of the one group are held at the tubular containers or at the closure elements by the first retainer members of one of the two parallel retaining plates and at the tubular containers by the second retainer members of the other retaining plate, and the lidded containers of the other group are held at the tubular containers or at the closure elements by the first retainer members of the other retaining plate and at the tubular containers by the second retainer members of one of the two parallel retaining plates.

6. The unit according to claim 1, in which the retainer members are disposed in rows and columns.

7. The unit according to claim 6, in which the first and second retainer members are disposed in rows and columns, alternating in each row and in each column, and the first retainer members and the second retainer members are disposed offset to each other in adjacent rows and columns.

8. The unit according to claim 1, in which at least one of the retaining plates, the holder, the lidded containers and the housing are produced from at least one plastic.

9. A transport and working device having a transport unit comprising two parallel retaining plates, which have an arrangement of retainer members for retaining lidded containers, and a plurality of lidded containers, each having a tubular container and a closure element at the top of the container projecting radially outwards with respect to the container, wherein lidded containers of one group are held parallel to each other by retainer members of one of the two parallel retaining plates, and lidded containers of another group are held parallel to each other by retainer members of the other retaining plate, the lidded containers of the one group are disposed oppositely aligned to the lidded containers of the other group and nested in each other such that the lidded containers of the one group contact the liquid containers of the other group and frictional forces acting between the lidded containers of the one group and the other group hold the transport unit together, and the transport and working device having a holder, which has a base, and support members projecting upwards from the base, upon which at least one retaining plate can be placed with a group of containers of the transport unit disposed therein.

10. The device according to claim 9, in which the lidded containers have slightly conical cylindrical regions, the retainer members and the slightly conical cylindrical regions are dimensioned such that with one of the two parallel retaining plates removed from the holder, the lidded containers can be inserted into a deep position in the retainer members, in which they are held at the slightly conical cylindrical regions clamped by the retainer members, and in which the support members and the slightly conical cylindrical regions are dimensioned such that with one of the two parallel retaining plates resting on the support members, the retaining plate resting on the on the support members is lowered with respect to the slightly conical cylindrical regions of the lidded containers such that the lidded containers are held with a clearance by the retainer members of the retaining plate so lowered.

11. The device according to claim 9, in which at least one of the two parallel retaining plates has first retainer members for retaining lidded containers having a first diameter of said lidded containers and second retainer members for retaining lidded containers having a second diameter of said lidded containers.

12. The device according to claim 9, in which the support members have posts projecting from the base, side walls projecting from the base or posts projecting from the base and side walls projecting from the base.

13. The device according to claim 9, in which the support members have alignment members at the top, and one of the two parallel retaining plates has further alignment members, at which the retaining plate having further alignment members is aligned with the alignment members.

14. The device according to claim 9, in which arranged on the top side of the base are positioning members, which are arranged opposite the retainer members on one of the two parallel retaining plates, and the lidded containers held by the retainer members are held at the lower ends thereof by the positioning members.

15. The device according to claim 14, in which the positioning members fit into recesses on the top side of the base receiving the lower ends of the lidded containers, or held in position via a coating on the top side of the base providing an increased static friction to the positioning members that hold the lower ends of the lidded containers, or said positioning members are held to the base via said recesses and said coating.

16. The device according to claim 9, in which the holder has feet on the bottom side of the base that are composed of a material of plastic, ceramic, stoneware or glass at the lower end thereof.

17. The device according to claim 9, in which the holder and the inserted lidded containers, or one of the two parallel retaining plates equipped with lidded containers, or said holder and one of the two parallel retaining plates are disposed in a housing.

18. The unit according to claim 9, in which the spacing between adjacent retainer members is 55 to 65 mm, and the retaining plate and the holder have a rectangular base area having one or more edge lengths of 130 mm each or an integer multiple or factor thereof.

* * * * *